US005745939A

United States Patent [19]

Flick et al.

[11] Patent Number: 5,745,939

[45] Date of Patent: May 5, 1998

[54] LEG REST

[75] Inventors: Roland E. Flick, Elma, N.Y.; John K. Whitney, Dorado, Puerto Rico

[73] Assignee: Gaymar Industries, Inc., Orchard Park, N.Y.

[21] Appl. No.: 748,206

[22] Filed: Nov. 12, 1996

[51] Int. Cl.[6] ..... A61G 7/075; A47C 20/00

[52] U.S. Cl. ..... 5/648; 5/490; 5/650; 5/655.3; 5/655.9

[58] Field of Search ..... 5/648, 650, 651, 5/652, 655.3, 655.9, 490; 129/845, 882

[56] References Cited

U.S. PATENT DOCUMENTS

| | | | |
|---|---|---|---|
| 2,281,629 | 5/1942 | Snow | 5/327 |
| 2,324,619 | 7/1943 | Dunn | 5/648 X |
| 2,709,435 | 5/1955 | Kress | 128/260 |
| 3,162,486 | 12/1964 | Emery | 297/439 |
| 3,345,656 | 10/1967 | Steinman | 5/327 |
| 3,426,272 | 2/1969 | Enclow | 5/490 X |
| 3,901,228 | 8/1975 | Brown | 128/133 |
| 3,931,654 | 1/1976 | Spann | 5/327 |
| 3,946,451 | 3/1976 | Spann | 5/327 |
| 4,071,031 | 1/1978 | Lowman | 128/402 |
| 4,227,270 | 10/1980 | Rivera | 5/436 |
| 4,397,052 | 8/1983 | Lund, III | 5/431 |
| 4,574,412 | 3/1986 | Smith | 5/436 |
| 4,805,605 | 2/1989 | Glassman | 5/650 X |
| 4,910,818 | 3/1990 | Grabill et al. | 5/650 |
| 5,012,539 | 5/1991 | Grigg | 5/431 |
| 5,134,739 | 8/1992 | Gaffe et al. | 5/648 |
| 5,173,979 | 12/1992 | Nennhaus | 5/490 X |
| 5,449,339 | 9/1995 | Drennan | 128/882 X |
| 5,476,105 | 12/1995 | Toth | 128/845 |
| 5,477,866 | 12/1995 | Davenport | 128/845 |

*Primary Examiner*—Michael F. Trettel

*Attorney, Agent, or Firm*—Christine Johnson; Hodgson, Russ, Andrews, Woods & Goodyear

[57] ABSTRACT

A leg rest for supporting a patient's legs while the patient is lying on a bed and during turning or otherwise managing the patient. The leg rest includes a pair of trough portions for receiving the patient's legs and a raised central portion and a pair of raised side portions for keeping the legs apart and restraining sideways leg movement. The central and side portions extend beyond the trough portions for restraining sideways movement of the patient's feet as the patient's legs rest on the trough portions with the patient's feet projecting beyond the trough portions for pressure relief of the patient's heels. The leg rest may be inflatable so that it may be inexpensively produced and disposable and so that its pressure may be adjusted for patient comfort. The leg rest may be contained within a case which has a bib for underlying the patient's upper legs to prevent slippage of the leg rest out of position.

9 Claims, 3 Drawing Sheets

FIG. 1
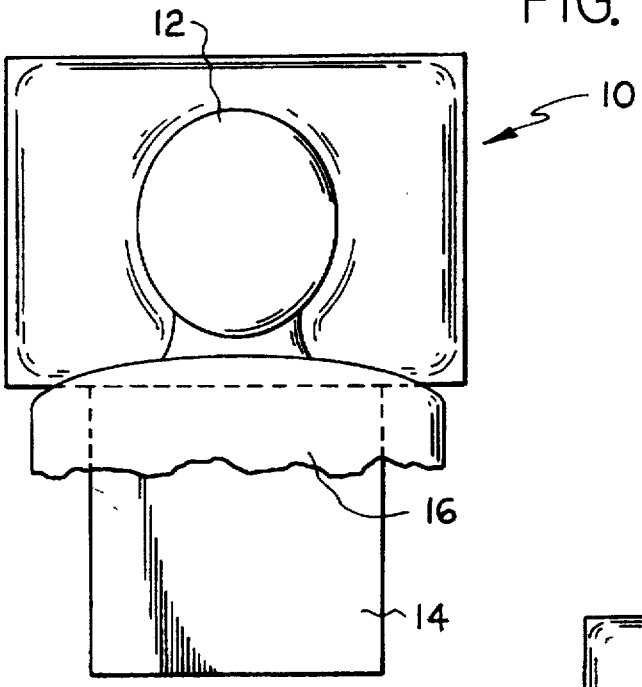
FIG. 2
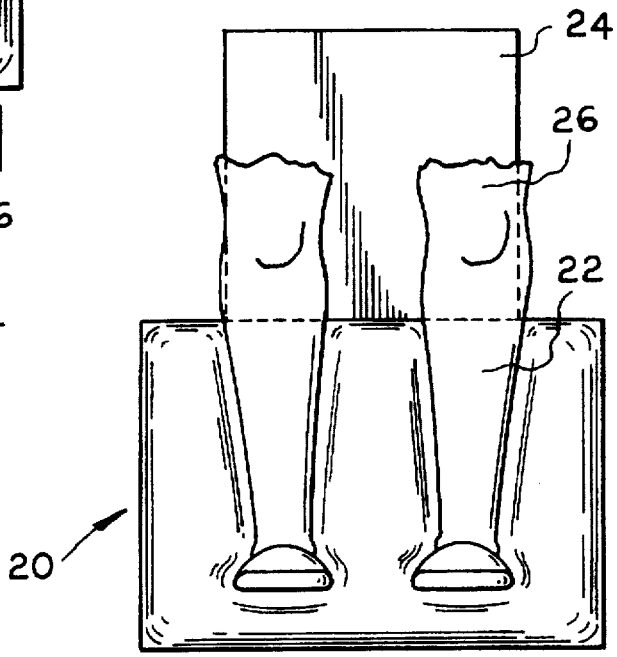
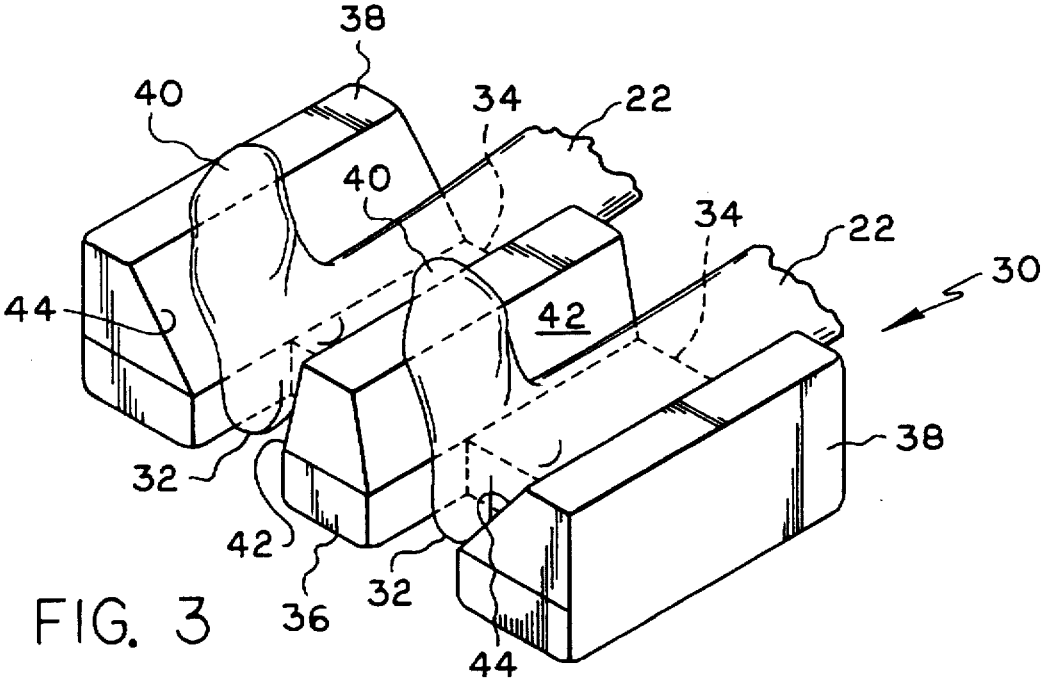
FIG. 3

FIG. 5
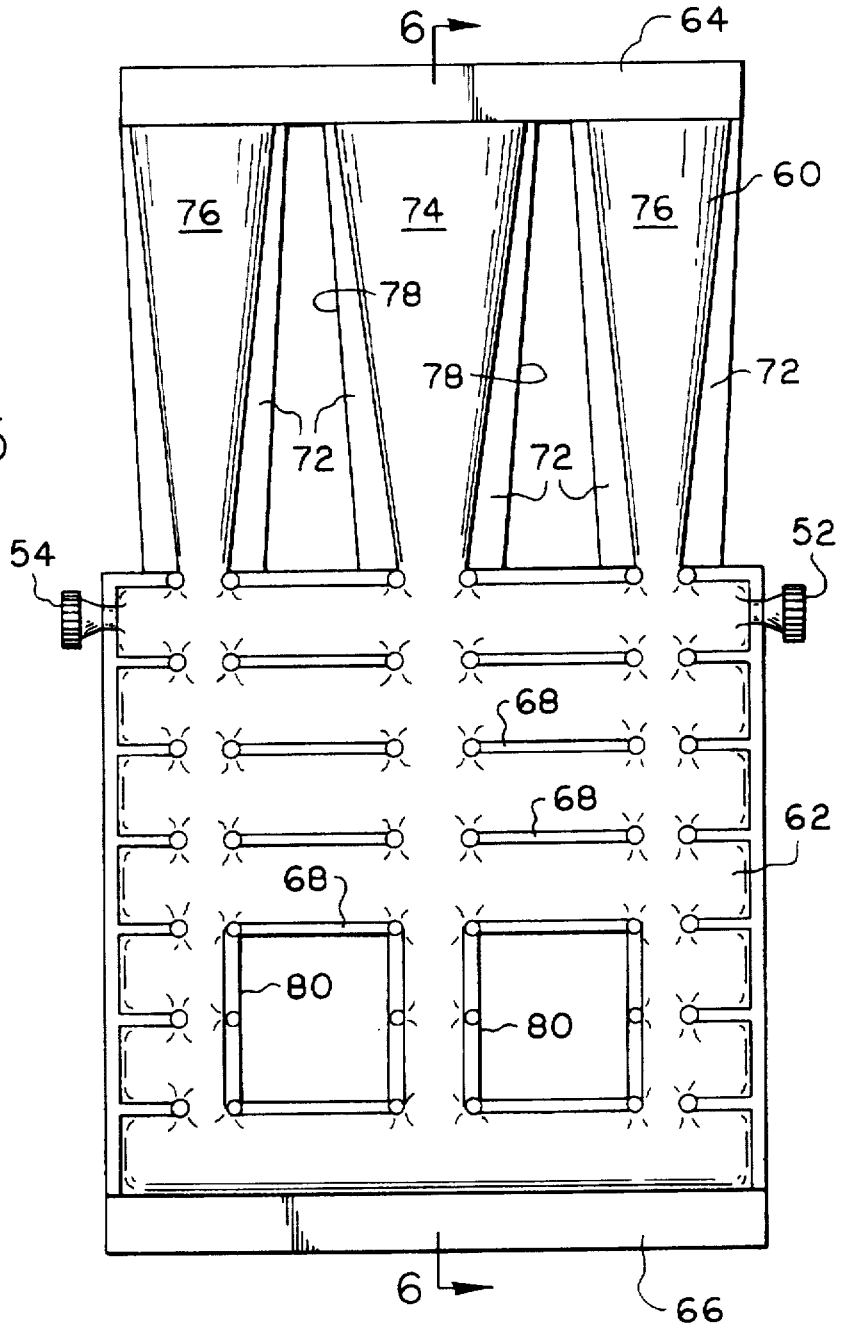
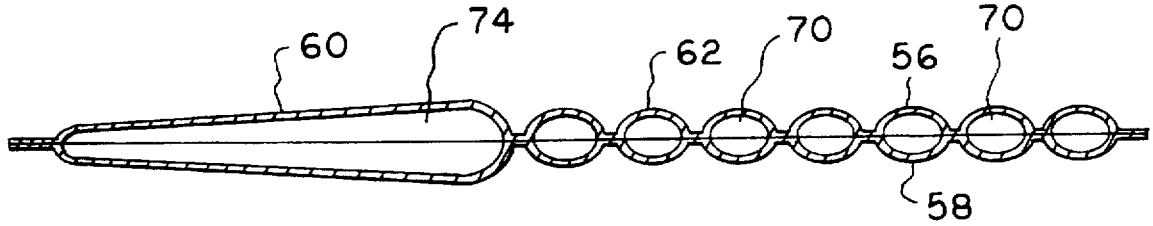
FIG. 6

LEG REST

The present invention relates generally to therapeutic devices for the lower limbs, which may be called leg rests.

Various leg or body support devices are disclosed in U.S. Pat. Nos. 3,162,486; 5,012,539; 5,134,739; 5,476,105; and 5,477,866. For example, U.S. Pat. No. 5,012,539 to Grigg discloses an inflatable multi-purpose medical support pillow.

Therapeutically, it is considered desirable, in a hospital or home care setting, to turn a bed-ridden patient from side to side periodically. The bed may be constructed so that the upper surface of its mattress is inclinable to one side so as to aid in this turning process. While the patient is lying on the bed and especially while turning or otherwise managing the patient, it is considered important that the legs be properly positioned but with enough freedom of foot movement that the knees are not hyperextended or twisted or otherwise stressed. It is also considered important to provide pressure relief for the heels while restraining movement of the feet to either the inside or outside.

U.S. Pat. No. 5,134,739 to Gaffe et al discloses a device composed of foam material for giving a set position to the lower limbs of persons required to remain in a supine position for an extended period. The device comprises a central block which is provided with two side support surfaces (cradles) for the legs of the person.

The central block of Gaffe et al is shown in FIGS. 1 and 2 thereof to extend beyond the ends of the cradles with a patient's heels overhanging the cradle ends. However, Gaffe et al does not provide any protection to a foot to prevent it from turning to the outside.

It is also considered important to maintain the leg rest position during inclining of the bed or when the patient is otherwise being turned as well as when the patient is in a supine position.

U.S. Pat. No. 4,227,270 to Rivera discloses a baby pillow case having a bottle holder on its upper surface and a sidewardly extending flap upon which a baby's head may rest for drinking from the bottle, as illustrated in FIG. 4 thereof. The flap is formed as a continuation of the top panel material. The teachings in Rivera are not directed to maintaining pillow position.

U.S. Pat. No. 4,574,412 to Smith discloses an L-shaped pillow anchored, for retaining it in position on a bed, by a sheet or panel of fabric placed on a bed under a person using the pillow. The pillow includes anchoring tabs which extend through openings in the pillowcase for connection with the sheet or panel along one edge portion thereof by Velcro fasteners. Such a complicated anchoring means would be unsuitable for the leg rest of the present invention.

It is accordingly an object of the present invention to comfortably and protectively position a patient's legs while the patient is therapeutically being turned from side to side as well as while the patient is in a supine position.

It is another object of the present invention to maintain leg rest position for the patient especially while the bed is being inclined.

In order to position the patient's legs comfortably and protectively, in accordance with the present invention a leg rest is provided which has a pair of trough portions for receiving the legs and raised central and side portions for restraining sideways leg movement. The patient's legs are positioned on the trough portions so that the feet are positioned beyond the trough portions for pressure relief thereof. The central and side portions maintain leg separation and restrain outside movement thereof. Moreover, the central and side portions project beyond the trough portions to restrain sideways movement of the patient's feet while suitably allowing foot rotation within the limits of the central and side portions so as not to stress the knees and ankles, especially during side-to-side turning of the patient on the bed.

The leg rest may be composed of a foam material to be reusable or be a more inexpensive disposable inflatable structure which is pressure adjustable for patient comfort.

In order to maintain leg rest position during inclining of the bed or otherwise, in accordance with the present invention the leg rest is enclosed in a case to which is attached a bib. The bib is placed to underlie the patient's upper legs so that the leg rest is anchored in position by the weight of the upper legs.

The above and other objects, features, and advantages of the present invention will be apparent in the following detailed description of the preferred embodiments thereof when read in conjunction with the accompanying drawings wherein the same reference numerals denote the same or similar parts throughout the several views.

BRIEF DESCRIPTION OF DRAWINGS

FIG. 1 is a plan view illustrating a patient lying on a pillow which is enclosed by a pillow case which embodies the present invention.

FIG. 2 is a plan view illustrating the support of a patient's legs on a leg rest which is enclosed by a case which embodies the present invention.

FIG. 3 is a perspective view of one embodiment of a leg rest which embodies the present invention and illustrating the support of the patient's legs thereon.

FIG. 5 is a plan view of the leg rest of FIG. 4 before it is folded and the ends connected together.

FIG. 6 is a sectional view thereof taken along lines 6—6 of FIG. 5.

DETAILED DESCRIPTION OF THE PREFERRED EMBODIMENTS

Figure 4:
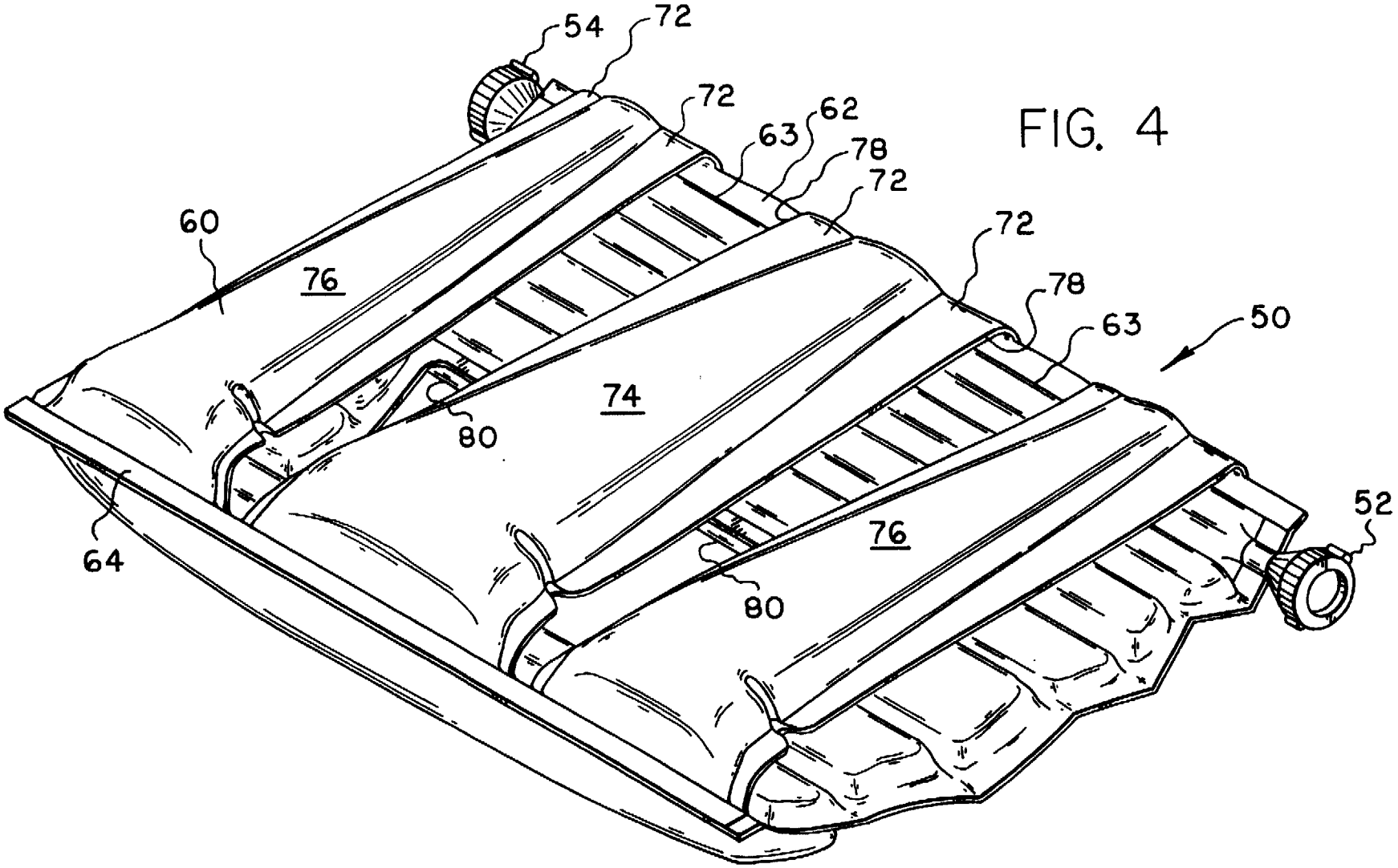
FIG. 4 is a perspective view of an alternative embodiment of the leg rest.

Referring to FIG. 1, there is shown generally at 10 a pillow case in which is received a pillow (not shown) on which a patient, illustrated at 12, in a hospital or home care setting may rest his or her head. It may sometimes be necessary to incline the bed to one side, at an angle of perhaps as much as 30 or 40 degrees, in order to therapeutically turn or otherwise manage the patient. In order to maintain the pillow in position during such inclining of the bed or during otherwise turning of the patient or even while the patent is lying in a supine position, a piece of cloth or bib 14 is integral with, sewed, or otherwise suitably connected to the pillow case 10 and positioned to unlie the patient's upper torso, illustrated at 16, so that the torso's weight restrains the pillow from movement out of position.

Referring to FIG. 2, there is shown generally at 20 a case which encloses a leg rest (not shown in FIG. 2) which may be either of the leg rests described hereinafter with respect to FIGS. 3 and 4 or any other suitable leg rest for receiving and suitably positioning the patient's lower legs 22. Suitably connected to the case 20 is a bib 24, which may be similar to bib 14 and which is positioned to underlie the patient's upper legs 26 so that the weight of the upper legs acts as an anchor to restrain movement of the leg rest especially during tilting of the bed. For example, the bib 24 may be about 16 inches long and 16 inches wide.

Referring to FIG. 3, there is shown generally at 30 a leg rest which, for ease of illustration, is not shown contained within case 20. It is of course not required that the leg rest 30 be contained within a case. The leg rest 30 is suitably placed at the foot end of a bed for a patient in a hospital or home care setting to keep the legs separated, especially when the mattress is being inclined at an angle to one side for therapeutic side-to-side turning of the patient or otherwise managing the patient, as well as to pressure-relieve the patient's heels 32. The leg rest 30 is a cushion composed of a foam or other suitable material so that it is reusable.

The leg rest 30 has a pair of elongate trough portions 34 shaped for receiving the patient's lower legs 22 respectively with the lower legs resting on the trough portions respectively. The leg rest 30 also has a raised central portion 36 separating the trough portions 34 to keep the patient's legs apart and a pair of raised side portions 38 defining the outer boundaries of the trough portions 34 respectively to restrain sideways movement of the patient's legs. By "trough portion" is meant a portion whose upper surface (upon which a patient's lower leg lies) is below the upper surfaces of the adjacent central and side portions. The corners and edges of the leg rest 30 may be suitably rounded.

In order to pressure-relieve the heels 32, the leg rest 30 is positioned on the foot end of the bed and the lower legs 22 are positioned to lie on the trough portions 34 respectively and extending beyond the trough portions 34 so that the heels 32 are suspended off of the ends of the trough portions 34.

It is considered important that the patient's feet 40 be restrained from excessive sideways movement to both left and right. In order to restrain such foot movement, in accordance with the present invention, both the central and side portions 36 and 38 respectively project or extend beyond the trough portions 34. In order to allow rotational freedom of foot movement so that the knees are not hyperextended or twisted or otherwise stressed especially during therapeutic turning of the patient, the upper parts 42 of the side surfaces of the central portion 36 and the upper parts 44 of the side surfaces of the side portions 38 which face inwardly are canted away from the respective trough portions 34. Thus, the patient's legs and feet are suitably rested so as to have freedom of orderly movement while being suitably restrained from sideways movement.

Referring to FIGS. 4, 5, and 6, there is shown generally at 50 a leg rest in accordance with an alternative embodiment of the present invention. As seen in FIG. 6, the leg rest 50 is a cushion composed of two sheets 56 and 58 of plastic or other suitable air-impervious material heat welded or otherwise suitably joined to provide air chambers therebetween, as discussed hereinafter, so that the leg rest 50 may be inexpensively made and disposable. The pressurization of the leg rest may be adjusted for patient comfort. An air inlet is illustrated at 52. An optional second air inlet is illustrated at 54. The air inlets contain check valves (not shown).

The leg rest 50 is folded to have upper and lower portions 60 and 62 respectively which are heat welded or otherwise suitably connected at its ends 64 and 66 respectively. FIG. 5 shows the leg rest 50 before it is folded and its ends connected.

In the bottom portion 62, the upper and lower layers 56 and 58 respectively are welded or otherwise suitably connected together as at cross-wise extending heat welds 68 to provide non-ballooning interconnected air chamber portions 70 (FIG. 6).

In the upper portion 60, the upper and lower layers 56 and 58 respectively are also welded or otherwise suitably connected together as at longitudinally extending heat welds 72 to provide longitudinally extending air chamber portions which interconnect with air chamber portions 70. These air chamber portions in the upper portion 60 comprise a central portion 74 and a pair of side portions 76 which correspond to central portion 36 and side portions 38 respectively of the leg rest 30 of FIG. 3. Between the central portion 74 and each of the side portions 76 is a cut-out, illustrated at 78, for receiving the patient's upper legs respectively so that they lie on the lower portion 62 and between the central portion 74 and side portions 76 respectively, which are accordingly raised in height relative to the lower portion 62. Thus, the segments 63 of the lower portion 62 on which the legs rest serve as trough portions.

A pair of cut-outs 80 are provided in the lower portion 62 in line vertically with the cut-outs 78 respectively for receiving (suspending) the patient's heels for pressure-relief thereof. Thus, the leg rest 50 is positioned on the foot of a bed and the patient's lower legs 22 positioned in the cut-outs 78 and lying on the bottom portion 62 with the heels 32 suspended in the cut-outs 80 respectively. Sealing welds are of course provided all the way around each of the cut-outs 78 and 80 as well as around the perimeter of the leg rest 50. It can be seen in FIG. 4 that the central and side portions 74 and 76 extend alongside the cut-outs 80 respectively to suitably restrain sideways foot rotation.

The leg rest 50 may, for example, have, when unfolded as in FIG. 5, a width of about 22 inches and a length of about 43 inches. The cut-outs 80 may each have a length and width, for example, of about 7 inches. Each of the cut-outs 78 may have a width, for example, of about 3 inches with the sealed strips 72 adding perhaps another 2 inches of effective width.

Thus, there is provided in accordance with the present invention a leg rest which allows freedom of orderly movement of the patient's lower legs and feet so that the knees are not unduly stressed and provides pressure relief to the heels yet keeps the legs apart and restrains sideways rotation of the feet either to the left or right. The leg rest may be placed in a case for use, and a bib connected to the case caused to underlie the patient's upper legs to prevent slippage of the leg rest out of the desired position.

While the invention has been described in detail herein, it will be understood that the invention may be embodied otherwise without departing therefrom, and such other embodiments are meant to come within the scope of the present invention as defined in the appended claims.

What is claimed is:

1. A leg rest for supporting a person's legs while the person is lying on a bed, the leg rest comprising a cushion having a pair of trough portions for receiving a person's legs and further comprising a raised central portion and a pair of raised side portions for restraining sideways leg movement, said central and side portions projecting beyond said trough portions thereby defining means for restraining sideways movement of the person's feet as the person's legs rest on the trough portions with the person's feet projecting beyond the trough portions.

2. A leg rest according to claim 1 wherein said cushion is inflatable.

3. A leg rest according to claim 1 further comprising a case for containing said cushion, said case including means for retaining leg rest position comprising a bib for underlying the person's upper legs.

4. A leg rest according to claim 3 wherein said cushion is inflatable.

5. An inflatable leg rest comprising an elongate air chamber means having a pair of ends and a pair of sides, said air chamber means folded and connected at said ends to define upper and lower portions, said upper portion having a pair of cut-out means defining means for receiving a person's legs onto said lower portion and a central and a pair of side portions for restraining sideways leg movement, and means comprising a pair of cut-out means on said lower portion and underlying said upper portion cut-out means for receiving and pressure relieving the person's heels.

6. A leg rest according to claim 5 further comprising a case for containing said air chamber means, said case including means for retaining leg rest position comprising a bib for underlying the person's upper legs.

7. A method for maintaining a position on a bed of a leg rest including trough portions for receiving the legs of a patient, the method comprising the steps of (a) inserting the leg rest within a case having a bib extending therefrom, (b) placing the leg rest in position on the bed and a person's lower legs on the leg rest, and (c) positioning the bib to underlie the person's upper legs.

8. A case for a leg rest comprising: a member for removably receiving the leg rest, means defining a bib extending from said member to at least the upper legs of a person when the person's feet are resting upon said leg rest, such that said upper legs of said person weigh upon said means defining a bib thereby restraining movement of said leg rest.

9. A case according to claim 8 in combination with a leg rest receivable within said member.

* * * * *